US007204176B2

(12) United States Patent
Wu

(10) Patent No.: US 7,204,176 B2
(45) Date of Patent: Apr. 17, 2007

(54) WRENCH WITH TWO PIVOTABLE SECTIONS

(75) Inventor: Pi-Liang Wu, Taichung (TW)

(73) Assignee: Yu Feng Industrial Co., Ltd., Taichung (TW)

( * ) Notice: Subject to any disclaimer, the term of this patent is extended or adjusted under 35 U.S.C. 154(b) by 0 days.

(21) Appl. No.: 11/176,323

(22) Filed: Jul. 8, 2005

(65) Prior Publication Data

US 2006/0156871 A1 Jul. 20, 2006

(30) Foreign Application Priority Data

Jan. 17, 2005 (TW) ..... 94200820 U
Apr. 19, 2005 (TW) ..... 94206087 U

(51) Int. Cl.
*B25B 23/16* (2006.01)

(52) U.S. Cl. ..... 81/177.7; 81/125.1; 81/177.2

(58) Field of Classification Search .... 81/177.6–177.9, 81/177.2, 121.1, 125.1, 60
See application file for complete search history.

(56) References Cited

U.S. PATENT DOCUMENTS 918,505 A * 4/1909 Burnett ..... 81/63
1,003,997 A * 9/1911 Dudly, Sr. ..... 81/125.1
1,578,065 A * 3/1926 Bemus et al. ..... 81/61
1,618,046 A * 2/1927 Barb ..... 81/125.1
1,747,527 A * 2/1930 Peterson ..... 81/177.8
2,156,285 A * 5/1939 Harris ..... 81/119
2,426,763 A * 9/1947 Curtis ..... 81/125.1
4,004,476 A * 1/1977 DeVrou ..... 81/177.2
6,588,303 B1 * 7/2003 Walsh ..... 81/13
2004/0025646 A1 * 2/2004 Hsien ..... 81/125.1

* cited by examiner

*Primary Examiner*—D. S. Meislin

(57) ABSTRACT

A wrench includes a handle with a first driving portion extending from one side of a first end of the handle and a pivotable section has one end thereof pivotably connected to a second end of the handle. A second driving portion extends from one side of the other end of the pivotable section. The first and second driving portions are able to engage with an object and the first driving portion can output a larger torque to loose or tight the object, and the second driving portion is used to output a smaller torque. The pivotable section is rotatable about a pivot for connecting the pivot section to the handle so that the user may hold the handle and rotate the pivot section continuously to remove the object from the hole where the object is engaged therewith.

7 Claims, 9 Drawing Sheets

WRENCH WITH TWO PIVOTABLE SECTIONS

FIELD OF THE INVENTION

The present invention relates to a wrench with two pivotable sections so as to be used in a narrow space to quickly rotate objects.

BACKGROUND OF THE INVENTION

As shown in FIG. 1, a conventional wrench for loosening or tightening objects such as bolts generally includes a handle 1 and a driving stud 2 which extends perpendicularly from a side of the handle 1. However, in a narrow space such as engine room of vehicles, the conventional wrench for loosening or tightening bolts on blades of fan, belt wheels or other rotatable parts in the engine room has to engage the driving stud 2 with the objects and then the user rotates the handle 1 an angle. The driving stud 2 is then removed from the object and the handle 1 is arranged to a desired position and the driving stud 2 is re-engaged with the object again so as to rotate the object for another angle.

The user has to repeat the action several times until the object is loosened or tightened. Due to the narrow space, when the object is located deep in the engine room and other parts are located above the object, the user cannot see the object directly so that he or she has to re-engage the driving stud 2 with the object by touch of his or her fingers and this is a time-consuming task The present invention intends to provide a wrench comprising a handle and a pivotable section and each of the handle and the pivotable section includes a driving portion so that the driving portion on the handle is able to output a larger torque and the driving portion on the pivotable section is able to output a smaller torque.

SUMMARY OF THE INVENTION

The present invention relates to a wrench that comprises a handle with a first driving portion extending from one side of a first end of the handle and a pivotable section has one end thereof pivotably connected to a second end of the handle. A second driving portion extends from one side of the other end of the pivotable section.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
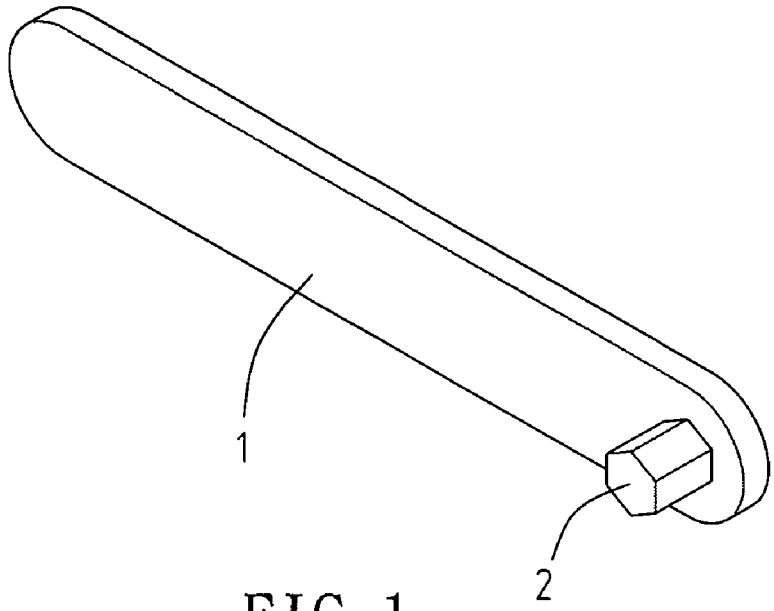
FIG. 1 PRIOR ART
FIG. 1 shows a conventional wrench.
Figure 2:
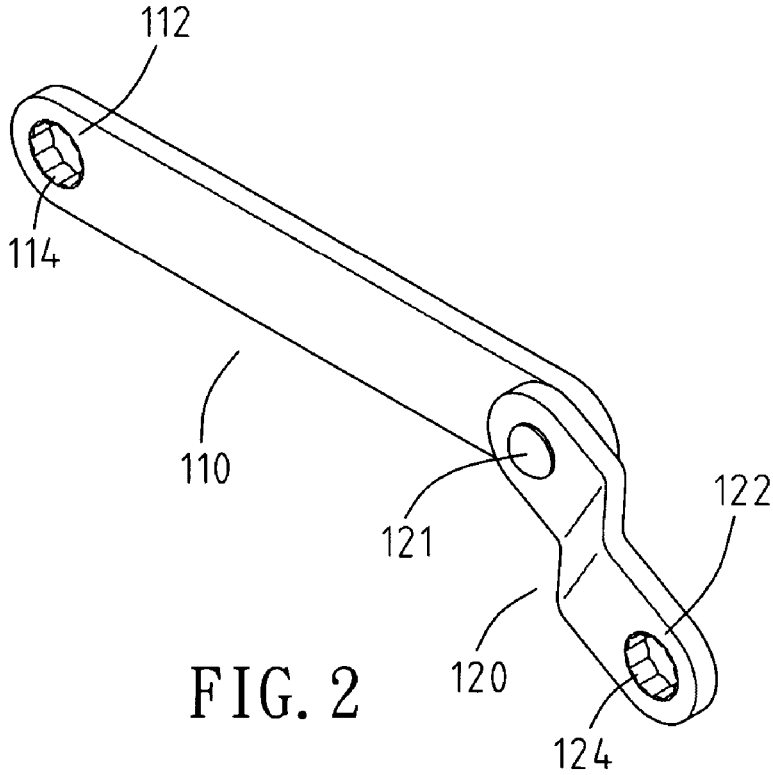
FIG. 2 shows a first embodiment of the wrench of the present invention.
Figure 3:
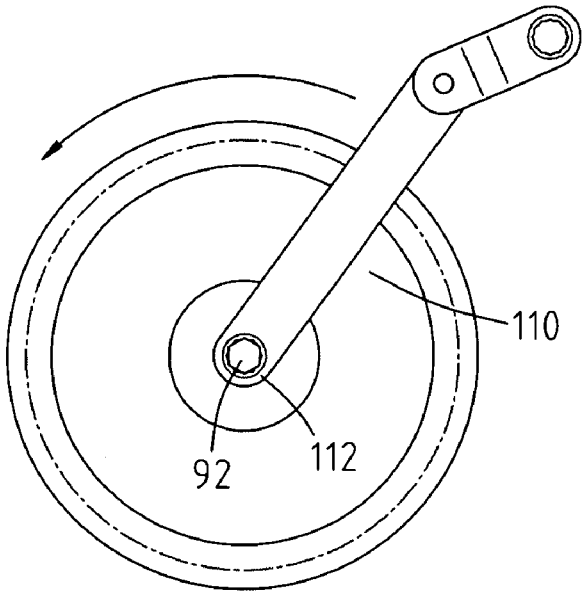
FIG. 3 shows the first hole is engaged With an object to be rotated.
Figure 4:
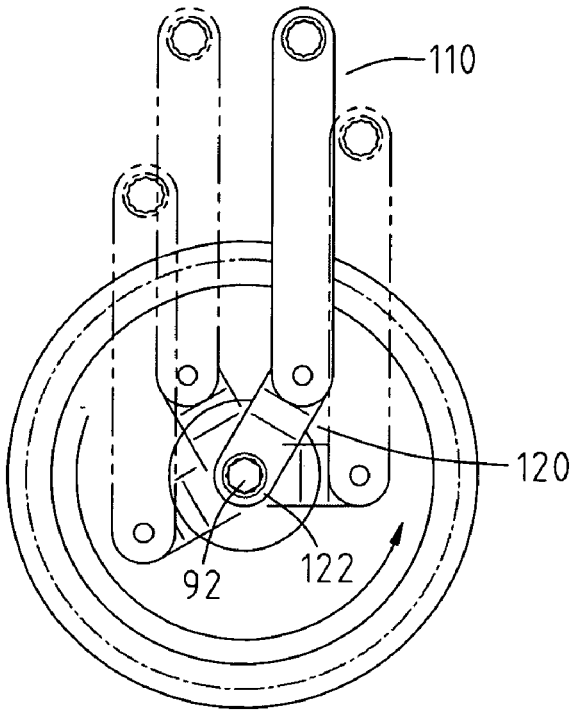
FIG. 4 shows the object is engaged with the second hole in the pivotable section which is rotated about a pivot for connecting the pivotable section to the handle.

Referring to FIGS. 2 to 4, the first embodiment of the wrench of the present invention comprises a handle 110 which is a flat elongate bar and a first hole 112 is defined through a first end of the handle 110. A pivotable section 120 has one end thereof pivotally connected to a second end of the handle 110 by a pivot 121 and a second hole 122 is defined through the other end of the pivotable section 120. Each of the first and second holes 112, 122 includes a plurality of protrusions 114/124 extending from an inner periphery thereof. The first hole 112 is mounted to an object 92 as shown in FIG. 3 and the user may rotate the handle 110 to output a larger torque to tighten or loosened the object 92. After the object is loosened, the second hole 122 is used to mount on the object 92 and the pivotable section 120 is pivoted about the pin 121 to quickly rotate the object 92 with smaller torque. By this way, the user simply holds the handle 110 and pivots the pivotable section 120 continuously at a narrow space to rotate the object 92.

Figure 5:
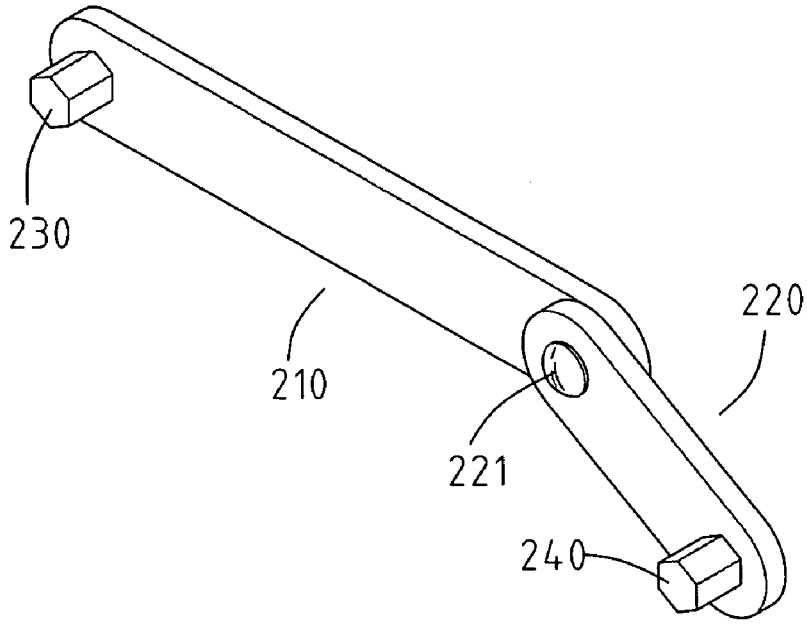
FIG. 5 shows a second embodiment of the wrench of the present invention.
Figure 6:
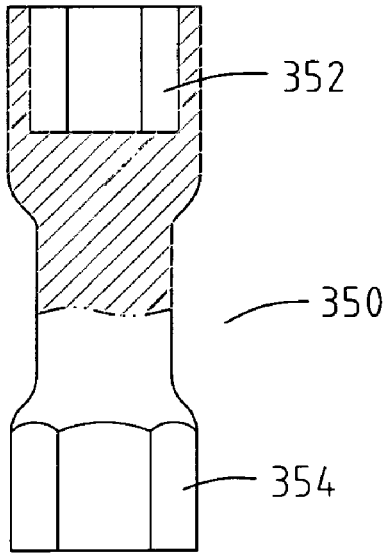
FIG. 6 shows a connection member for cooperated with the wrench of the present invention.
Figure 7:
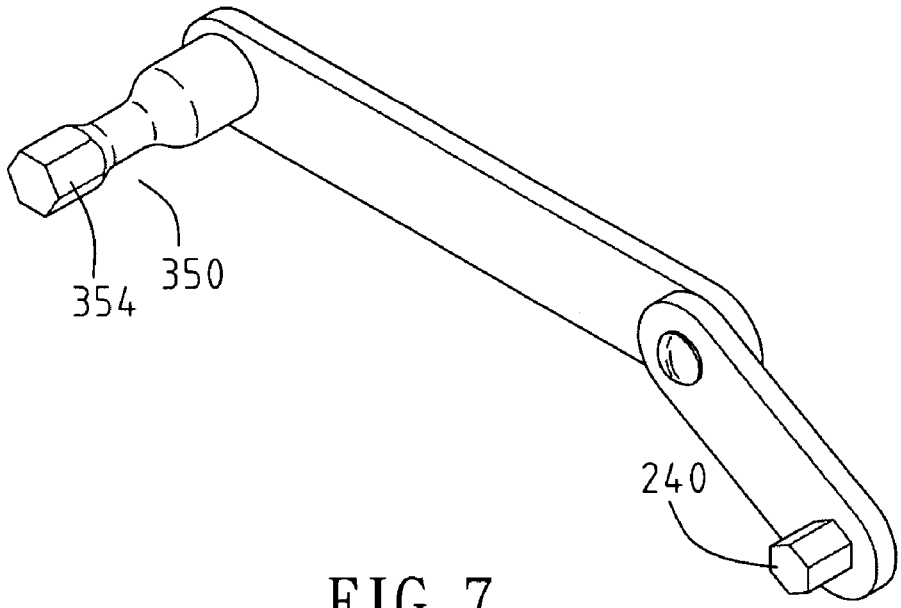
FIG. 7 shows that the connection member is connected to the first driving stud.
Figure 8:
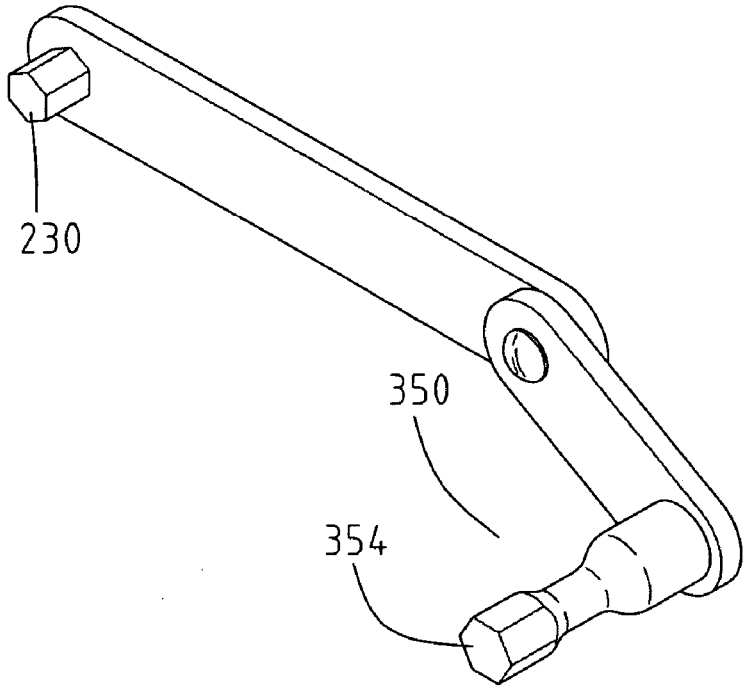
FIG. 8 shows that the connection member is connected to the second driving stud.

FIG. 5 shows a second embodiment of the wrench, wherein the handle 210 has a first driving portion 230 perpendicularly extending from one side of a first end of the handle 210 and the pivotable section 220 has one end thereof pivotably connected to a second end of the handle 210 by a pivot 221. A second driving portion 240 perpendicularly extends from one side of the other end of the pivotable section 220. Each of the first and second driving portions 230, 240 is a hexagonal protrusion so as to be inserted with a recess of an object (both not shown). FIG. 6 shows a connection member 350 that is able to be cooperated with the first and second driving portions 230, 240, wherein the connection member 350 has a recess 352 defined in an end thereof and the other end of the connection member 350 is a polygonal end 354. One of the first driving portion 230 and the second driving portion 240 is engaged with the recess 352 as shown in FIGS. 7 and 8 so as to reach an object at a deeper position. The polygonal end 354 of the connection member 350 can be used to drive objects.

Figure 9:
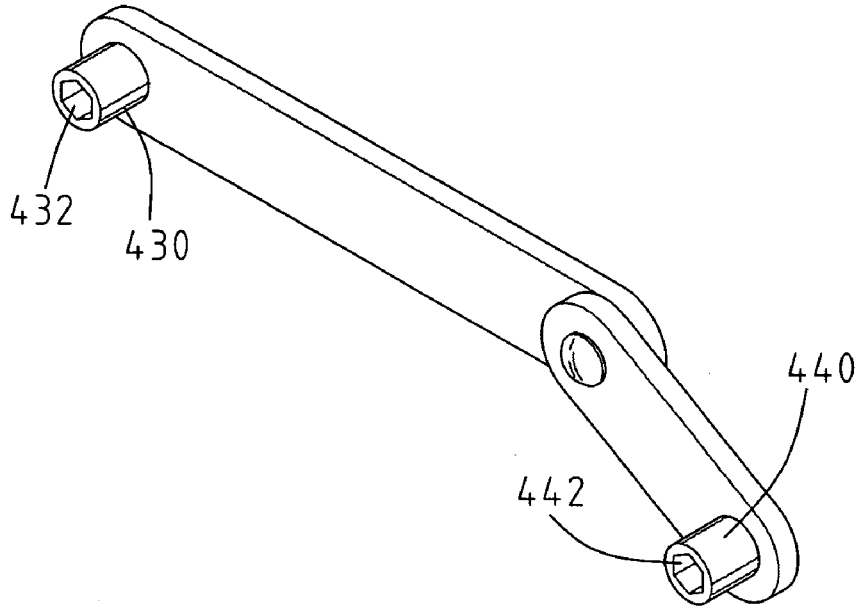
FIG. 9 shows a third embodiment of the wrench of the present invention.
Figure 10:
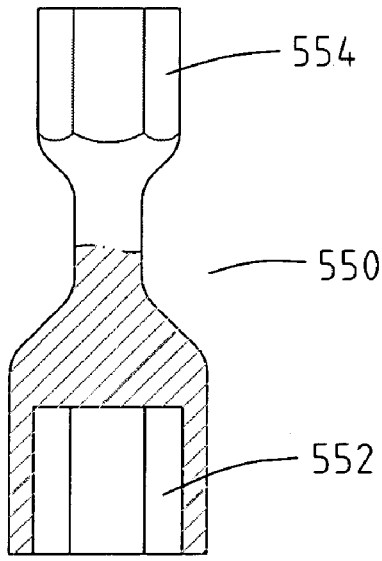
FIG. 10 shows another connection rod.
Figure 11:
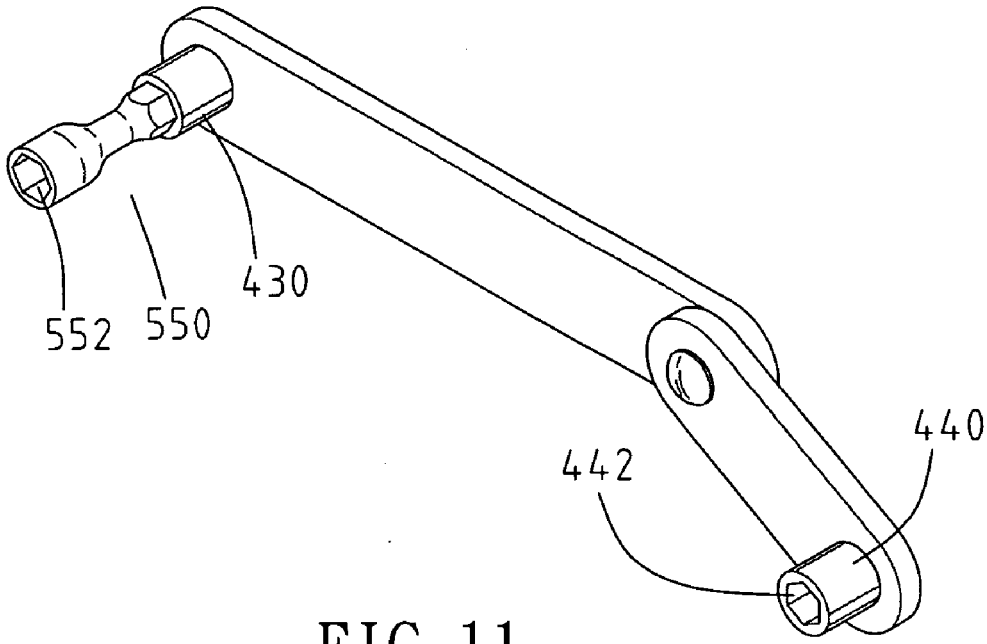
FIGS. 11 and 12 show that the connection rod in FIG. 10 is connected to the first and second driving studs respectively.
Figure 12:
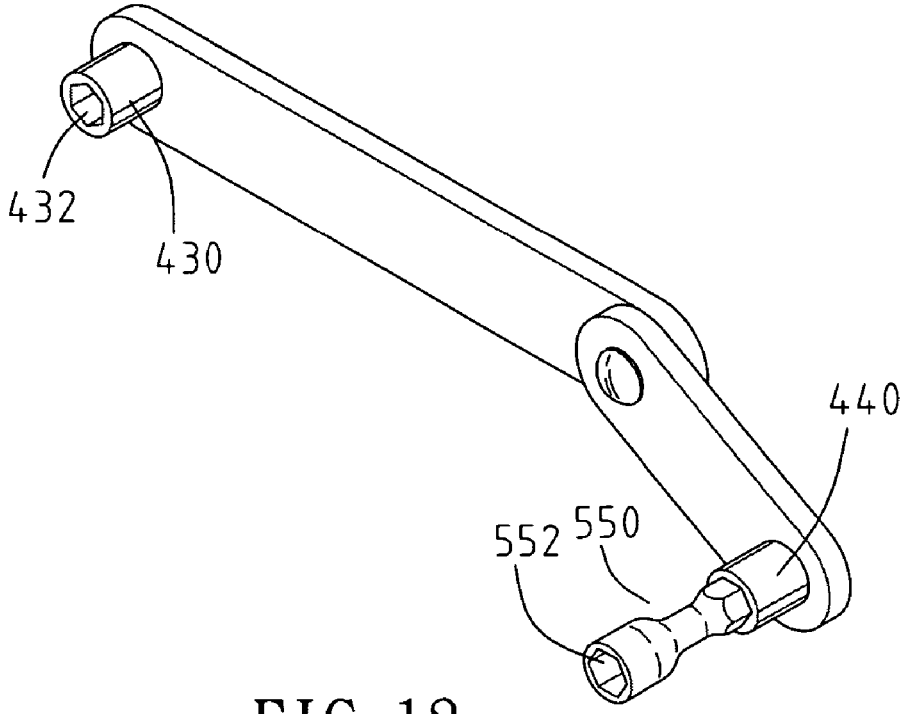

FIG. 9 shows a third embodiment of the wrench wherein the first driving portion 430 and the second driving portion 440 are tubular members perpendicularly extending from the handle and the pivotable section. The first and second driving portions 430, 440 have two respective polygonal recesses 432/442 defined in two respective ends thereof. FIG. 10 shows another embodiment of the connection member 550 wherein a recess 552 is defined in an end of the connection member 550 and the other end of the connection member 550 is a polygonal end 554. The polygonal end 554 is engaged with one of the polygonal recesses 432, 442 of the first driving portion 430 and the second driving portion 440, and the recess 552 is used to mount onto an object as shown in FIGS. 11 and 12.

Figure 13:
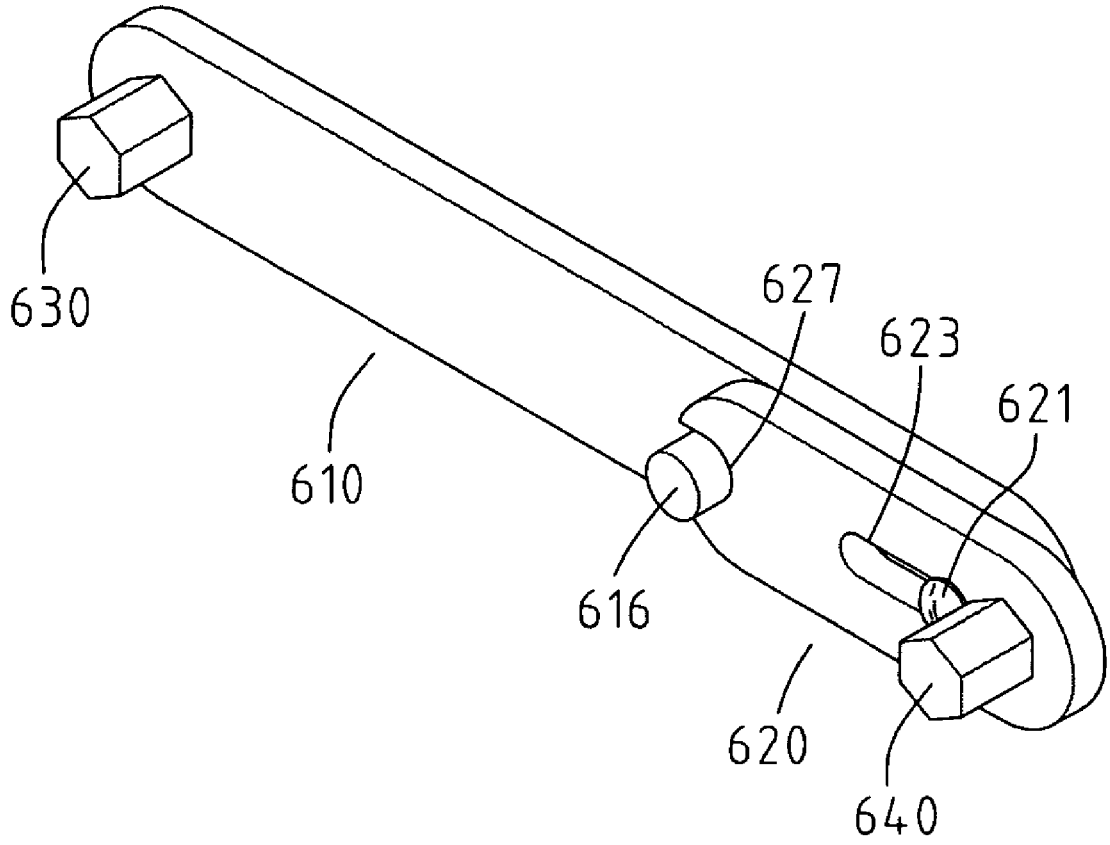
FIG. 13 shows a fourth embodiment of the wrench of the present invention.
Figure 14:
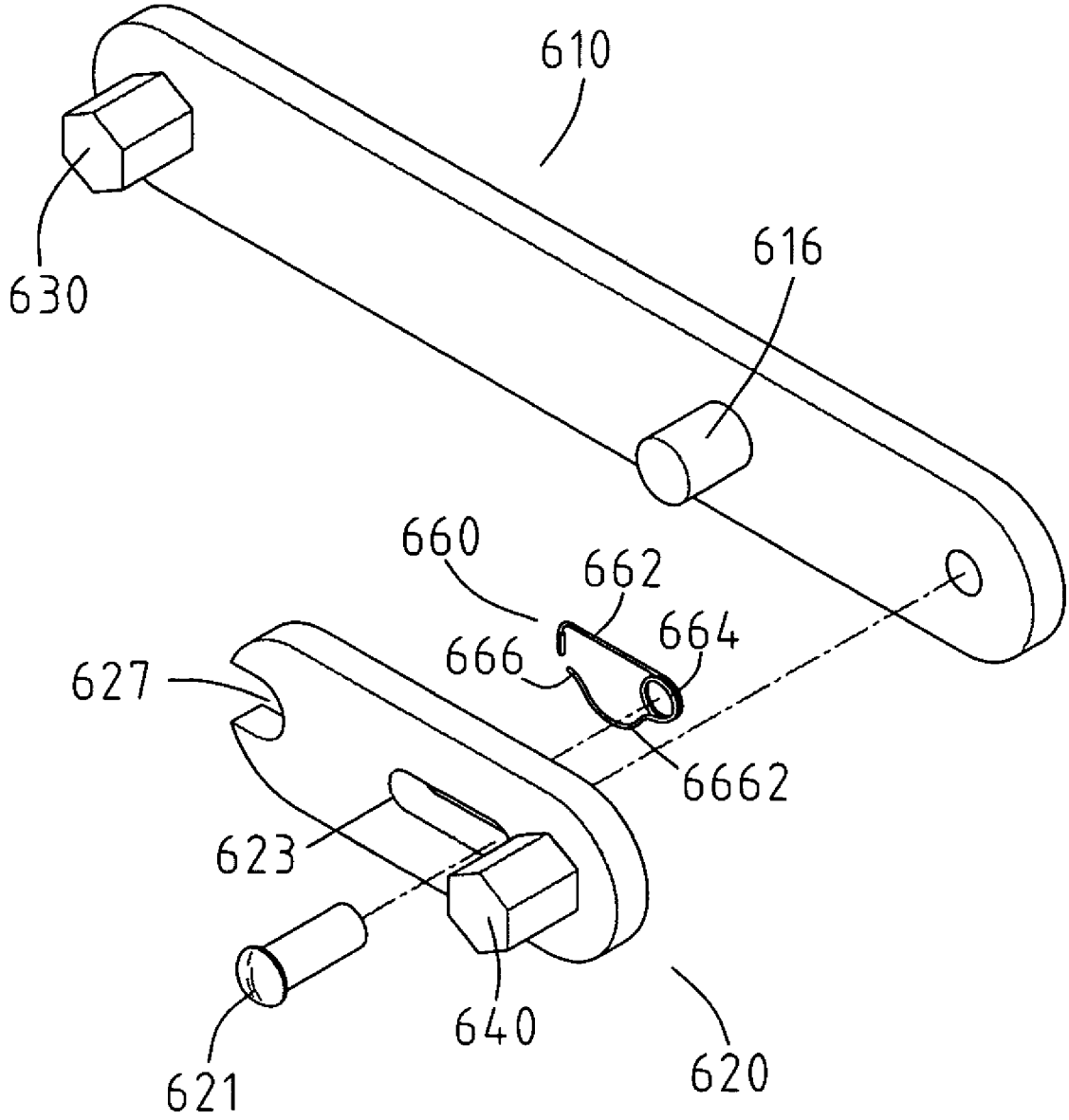
FIG. 14 is an exploded view to show the fourth embodiment of the wrench of the present invention.
Figure 15:
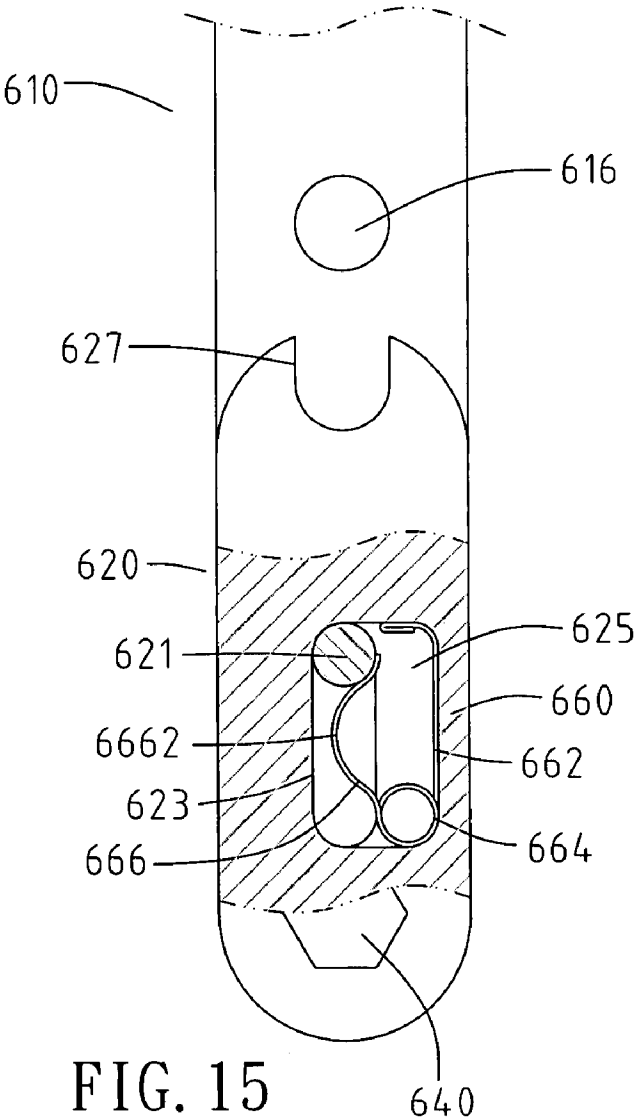
FIGS. 15 and 16 show the positioning rod are positioned at two different positions relative to the pivotable section of the wrench in FIG. 13.
Figure 16:
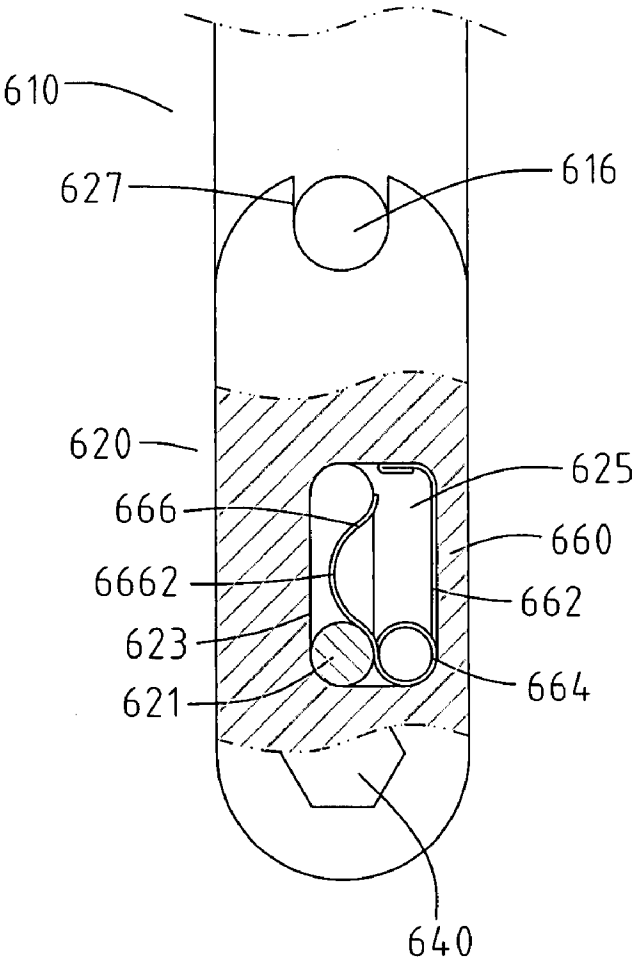

FIGS. 13 and 14 show a fourth embodiment of the wrench, wherein the first driving portion 630 and the second driving portion 640 are hexagonal protrusions which extend perpendicularly from the handle 610 and the pivotable section 620 respectively. The pivotable section 620 has a notch 627 defined in an end thereof and the second driving portion 640 extends from the other end of the pivotable section 620. An axial slot 623 is defined through the pivotable section 620 and the pivot 621 extends through the axial slot 623 and is connected to the handle 610. A positioning rod 616 extends from the handle 610 and is removably engaged with the notch 627. The pivotable section 620 has a recessed area 625 defined in a side facing the handle 610 and the recessed area 625 communicates with the axial slot 623. A spring member 660 made by a metal wire is received in the recessed area 625 and includes a contact section 662, a ring 664 and a positioning section 666. The contact section 662 and the positioning section 666 respectively extend from the ring 664 and include a free end so that the contact section 662 and the positioning section 666 have proper flexibility. The contact section 662 is in contact with an inside of the recessed area 625 and the positioning section 666 includes an outward portion 6662 which extends into a middle portion of the axial slot 623 and includes a smooth curve so that the pivot 621 can be positioned on either one of two ends of the outward portion 6662 as shown in FIGS. 15 and 16. The recessed area 625 is closed by the handle 610 so that the spring member 660 is positioned in the recessed area 625.

As shown in FIGS. 15 and 16, when the positioning rod 616 is engaged with the notch 627 of the pivotable section 620, the pivotable section 620 is not allowed to be pivoted relative to the handle 610 so that both the first and second driving portions 630, 640 are able to output larger torque. When the pivotable section 620 is pulled away from the positioning rod 616, the pivot 621 is shifted from the lower position (FIG. 15) to the top position (FIG. 16). The pivotable section 620 is allowed to be pivoted about the pivot 621.

While we have shown and described the embodiment in accordance with the present invention, it should be clear to those skilled in the art that further embodiments may be made without departing from the scope of the present invention.

What is claimed is:

1. A wrench comprising:

a handle and a first driving portion extending from one side of a first end of the handle, and a pivotable section having one end thereof pivotably connected to a second end of the handle by a pivot so that the pivotable section is pivoted about the pivot, the pivotable section having a notch defined in an end thereof and an axial slot defined through the pivotable section, the pivot extending through the axial slot and connected to the handle, a positioning rod extending from the handle and removably engaged with the notch, the pivotable section having a recessed area defined in a side facing the handle, the recessed area communicating with the axial slot, a spring member received in the recessed area so as to engage the pivot, a second driving portion extending from one side of the other end of the pivotable section.

2. The wrench as claimed in claim 1 further comprising a connection member which has one end connected to one of the first driving portion and the second driving portion.

3. The wrench as claimed in claim 2, wherein the first driving portion and the second driving portion are polygonal protrusions, the connection member includes a recess defined in an end thereof and the other end of the connection member is a polygonal end, one of the first driving portion and the second driving portion is engaged with the recess.

4. The wrench as claimed in claim 2, wherein the first driving portion and the second driving portion are tubular members and have two respective polygonal recesses defined in two respective ends thereof, the connection member includes a recess defined in an end thereof and the other end of the connection member is a polygonal end, the polygonal end is engaged with one of the polygonal recesses of the first driving portion and the second driving portion.

5. The wrench as claimed in claim 1, wherein the first driving portion and the second driving portion are tubular protrusions which extend perpendicularly from the handle and the pivotable section respectively.

6. The wrench as claimed in claim 1, wherein the spring member is made by a metal wire and includes a contact section, a ring and a positioning section, the contact section is in contact with an inside of the recessed area and the positioning section includes an outward portion which extends into a middle portion of the axial slot so as to position the pivot.

7. The wrench as claimed in claim 1, wherein the recessed area is closed by the handle so that the spring member is positioned in the recessed area.

* * * * *